US012247376B2

(12) United States Patent
Blum

(10) Patent No.: US 12,247,376 B2
(45) Date of Patent: Mar. 11, 2025

(54) JET REGULATOR

(71) Applicant: Neoperl GmbH, Müllheim (DE)

(72) Inventor: Gerhard Blum, Gutach (DE)

(73) Assignee: NEOPERL GMBH, Mullheim (DE)

( * ) Notice: Subject to any disclaimer, the term of this patent is extended or adjusted under 35 U.S.C. 154(b) by 416 days.

(21) Appl. No.: 17/775,951

(22) PCT Filed: Nov. 12, 2020

(86) PCT No.: PCT/EP2020/081938
§ 371 (c)(1),
(2) Date: May 11, 2022

(87) PCT Pub. No.: WO2021/094467
PCT Pub. Date: May 20, 2021

(65) Prior Publication Data

US 2022/0381014 A1 Dec. 1, 2022

(30) Foreign Application Priority Data

Nov. 14, 2019 (DE) ..... 20 2019 106 347.5

(51) Int. Cl.
*E03C 1/08* (2006.01)
*E03C 1/084* (2006.01)

(52) U.S. Cl.
CPC ..... *E03C 1/08* (2013.01); *E03C 1/084* (2013.01)

(58) Field of Classification Search
CPC ..... E03C 1/08; E03C 2001/082; E03C 1/084; E03C 1/086
See application file for complete search history.

(56) References Cited

U.S. PATENT DOCUMENTS

| | | | | | |
|---|---|---|---|---|---|
| 6,126,093 | A * | 10/2000 | Grether | E03C 1/084 | 239/553.5 |
| 2006/0102750 | A1* | 5/2006 | Grether | E03C 1/084 | 239/428.5 |
| 2007/0176024 | A1* | 8/2007 | Denzler | E03C 1/08 | 239/575 |
| 2008/0210777 | A1* | 9/2008 | Lacher | E03C 1/08 | 239/140 |
| 2009/0049600 | A1* | 2/2009 | Weis | E03C 1/086 | 4/678 |
| 2013/0134235 | A1* | 5/2013 | Blum | B05B 1/3402 | 239/428.5 |
| 2014/0217203 | A1* | 8/2014 | Zoller | E03C 1/084 | 239/428.5 |
| 2015/0197925 | A1 | 7/2015 | Stadtler | | |
| 2018/0087247 | A1* | 3/2018 | Blum | E03C 1/086 | |
| 2018/0282986 | A1* | 10/2018 | Blum | E03C 1/084 | |
| 2019/0234056 | A1* | 8/2019 | Willmann | E03C 1/084 | |
| 2020/0011036 | A1* | 1/2020 | Birmelin | E03C 1/084 | |
| 2020/0224395 | A1* | 7/2020 | Stein | E03C 1/086 | |

FOREIGN PATENT DOCUMENTS

| | | |
|---|---|---|
| DE | 102006046245 | 4/2008 |
| DE | 102017128758 | 6/2019 |
| WO | 2004033108 | 4/2004 |

* cited by examiner

*Primary Examiner* — Darren W Gorman
(74) *Attorney, Agent, or Firm* — Volpe Koenig

(57) ABSTRACT

In an outflow structure (10) of a jet regulator (1), holes (17, 19, 25) are formed in the edge region of a regular arrangement (12) which are enlarged with respect to the regular arrangement (12), in order to avoid the formation of small holes (17, 19, 25) in the edge region.

19 Claims, 3 Drawing Sheets

Prior Art

JET REGULATOR

TECHNICAL FIELD

The invention relates to a jet regulator having an outlet structure which has an outlet mesh having a regular arrangement of holes and a rim that delimits the outlet mesh, wherein holes of the outlet structure that are adjacent to the rim form a ring and externally delimit a water jet flowing through the outlet structure, wherein the ring is configured so as to deviate from the regular arrangement.

BACKGROUND

Jet regulators of this type are known and by now produced from plastics material using injection-molding technology. It has become customary to provide the outlet structure here with a regular arrangement of holes, for example a hexagonal arrangement of hexagonal holes, so as to form a uniform jet pattern. This regular arrangement finds its limits in the dimensions of the jet regulator, the latter potentially having, for example, a round or a rectangular contour, or any other external contour that deviates from that of the arrangement.

The arrangement of the holes and an available opening cross section of the holes here are mutually adapted such that individual jets which pass through the holes are re-combined behind the outlet structure so as to form a common water jet.

SUMMARY

The invention is based on the object of improving the jet pattern of a jet regulator of this type.

In order for the mentioned object to be achieved, one or more of the features disclosed herein are provided in a jet regulator according to the invention. In order for the mentioned object to be achieved in a jet regulator of the type described at the outset it is in particular proposed according to the invention that a hole of the ring, if the available opening cross section thereof otherwise, in the case of a continuation of the regular arrangement, would be half the size of an available opening cross section of an adjacent hole, it is enlarged so as to deviate from the regular arrangement. The invention here exploits the concept that the jet pattern is determined substantially by the sub-jets that pass through the holes of the ring. Moreover, the invention has recognized that excessively small holes in the ring generate sub-jets which do not completely re-combine with the other, adjacent sub-jets but rather have the tendency toward forming laterally diverting, interfering jets. By enlarging these excessively small holes, this resulting in a deviation from the uniform overall appearance of the arrangement, it may be possible to successfully reduce or even entirely avoid interfering jets of this type. The jet pattern is thus improved.

The ring can thus be defined as an accumulation of all those holes of the arrangement continued beyond the rim that are curtailed by the rim.

In one advantageous design embodiment it can be provided that the regular arrangement is formed by holes of identical size and/or identical shape. In this way, a regular arrangement and the deviations from such an arrangement can be readily identified.

In one advantageous design embodiment it can be provided that the ring is configured so as to deviate from the regular arrangement in that the rim curtails individual holes of the ring. In this way, adapting the arrangement to a geometry of the rim can be dispensed with.

In one advantageous design embodiment it can be provided that the enlarged hole of the ring is enlarged at the expense of at least one adjacent hole. In this way, a simple construction rule for the avoidance of excessively small holes in the ring is provided.

For example, the adjacent hole can lie in the ring. In this way, a difference in size between holes within the ring can be compensated for.

It can also be provided that the adjacent hole is in the interior of the outlet structure. In this way, excessively small holes can be repositioned inward, where said holes do not interfere.

It is particularly favorable here for each hole of the ring to be enlarged so as to deviate from the regular arrangement if the available opening cross section of said hole otherwise, in the case of a continuation of the regular arrangement, would be half the size of an available opening cross section of an adjacent hole. It is advantageous here that the formation of interfering jets along an entire circumference of the ring can be reduced or even avoided.

The jet regulator in the invention can be configured as an aerated or non-aerated jet regulator.

The outlet structure can have, for example, a round, oval, polygonal, in particular rectangular or square, external contour.

In one advantageous design embodiment it can be provided that a hole of the ring is enlarged so as to deviate from the regular arrangement when the available opening cross section of said hole otherwise, in the case of a continuation of the regular arrangement, deviates from the available opening cross section of the adjacent hole by more than 20%. It has been demonstrated that small holes of this type in particular facilitate the formation of interfering jets.

It is particularly advantageous here for the hole of the ring to be enlarged so as to deviate from the regular arrangement when the available opening cross section of said hole otherwise, in the case of a continuation of the regular arrangement, deviates from the available opening cross section of the adjacent hole by more than 15%. In this way, an ideally uniform distribution of opening cross sections within the ring can be achieved. This facilitates particularly uniform shaping of an external layer of the water jet, and thus a particularly uniform jet pattern.

In one advantageous design embodiment it can be provided that the holes of the ring have available opening cross sections which are at most 50% larger than the available opening cross section of a hole in the interior of the outlet structure. The holes in the interior of the outlet structure can thus be used as the reference size. It is advantageous here that the configuration of excessively large holes in the ring is avoidable.

It is particularly favorable here for the holes of the ring to have available opening cross sections which are at most 20%, in particular at most 15%, larger than the available opening cross section of a hole in the interior of the outlet structure. In this way, excessive deviations toward larger available opening cross sections of the holes in the ring are avoidable.

It can even be provided that the holes of the ring have available opening cross sections which are equal to or smaller than the available opening cross section of a hole in the interior of the outlet structure. In this way, a particularly uniform external appearance of the exiting jet can be achieved.

The mentioned surface area proportions mentioned here can relate to an arbitrary hole, for example to a median or mean value of the opening cross sections, in the interior of the outlet structure. The surface area proportions preferably relate to the largest hole or an uncurtailed hole (i.e. for example one of the identical holes of which the arrangement is composed) in the interior of the outlet structure. In this way, a natural upper limit can be defined.

In one advantageous design embodiment it can be provided that the available opening cross sections of the holes of the ring vary by at most 15%. In this way, the sub-jets of which an external layer of the jet, for example the external layer already mentioned, is composed can be defined so as to be of ideally identical size. This enables an ideally uniform jet pattern having ideally few interfering jets.

In one advantageous design embodiment it can be provided that the outlet structure has at least a rotational symmetry. In this way, a rotational symmetry of the outlet structure, for example a discrete or continuous rotational symmetry, may be transferable to the ring. This facilitates a particularly uniform configuration of a jet pattern.

Alternatively or additionally thereto, it can be provided that the outlet structure has at least a mirror symmetry. In this way, a mirror symmetry of the outlet structure, for example a flat mirror symmetry, may be transferable to the ring. This facilitates a particularly uniform configuration of a jet pattern.

Additionally or alternatively thereto, it can be provided that the outlet structure has at least a point symmetry. In this way, a point symmetry of the outlet structure, for example a symmetry which by way of punctiform mirroring at a center inherently transitions the outlet structure, may be transferable to the ring. This facilitates a particularly uniform configuration of a jet pattern.

In one advantageous design embodiment it can be provided that the outlet structure has a hexagonal arrangement.

Here, or in another design embodiment, it can be provided that the rim is configured so as to be circular. In this way, the invention can be used in jet regulators which can be screwed to a fitting by rotation.

In one advantageous design embodiment it can be provided that the outlet structure in the interior has at least one hole of which the available opening cross section is smaller than 50% of a further hole in the ring and/or in the interior. It has been demonstrated that the configuration of the very small holes in the interior does not interfere with the jet pattern so that other aspects, for example an appealing design or a desirable characteristic identification, can be taken into account here.

For example, this at least one hole in the interior of the outlet structure can be disposed so as to be adjacent to the ring. In this way it is possible to enlarge a hole in the ring at the expense of a hole in the interior. The arrangement otherwise can remain unchanged.

For example, the further hole in the ring or in the interior of the outlet structure can be a largest hole. In this way, an absolute upper limit in terms of the available opening cross sections can be specified.

For example, the further hole in the ring or in the interior of the outlet structure can be an uncurtailed hole. In this way, sizing can relate to identical holes of which the regular arrangement is composed.

A particularly minor adverse effect on the overall appearance of the outlet structure results when the enlarged hole in at least one (rim) portion assumes the shape of the arrangement.

The continuation of the arrangement up to the rim can be made possible in that the holes that form the ring have mutually deviating available opening cross sections, for example.

In one advantageous design embodiment it can be provided that at least one hole, which lies in the interior of the outlet structure and is adjacent to a hole of the ring, is curtailed by this hole of the ring in such a manner that the (remaining) available opening cross section is smaller than that of the uncurtailed holes of the regular arrangement. In this way, space is easily achieved for an enlargement of an excessively small hole in the ring. The invention has recognized that small holes in the interior, thus within the ring, do not interfere with the jet pattern.

In one advantageous design embodiment it can be provided that the at least one hole, at the expense of which the hole in the ring has been enlarged, has an opening cross section which differs from zero. In this way, excessive deviations from the regular pattern of the arrangement can be avoided.

In one advantageous design embodiment it can be provided that no hole of the ring has an opening cross section which is smaller than half of an available opening cross section of the largest and/or uncurtailed holes of the regular arrangement. In this way, excessively thin jets and/or excessively fine structures in the outlet structure can be easily avoided.

It can also be provided that the hole in the interior, at the expense of which the hole in the ring has been enlarged, is unified with a further hole in the interior, so as to form a larger hole.

In one advantageous design embodiment it can be provided that a shape and/or an arrangement of enlarged or curtailed holes maintain/maintains a rotational symmetry of the regular arrangement. In this way, a pleasing and/or appealing design can be achieved.

In one advantageous design embodiment it can be provided that a width of the ring is delimited by a largest available dimension of a largest and/or uncurtailed hole of the arrangement, in particular in the interior. In this way, a natural scale of the outlet structure can be utilized for dimensioning the width, thus a dimension transverse to the encircling direction of the ring, for example.

In one advantageous design embodiment it can be provided that rim portions in which the holes of the ring are delimited by the rim have in each case a length which is at least half of a largest available dimension of a largest and/or uncurtailed hole of the arrangement, in particular in the interior. The length of the rim portions can substantially determine the jet pattern, because said length defines an external dimension of the outer individual jets. In this way, excessively small individual jets can be avoided.

In one advantageous design embodiment it can alternatively or additionally be provided that rim portions in which the holes of the ring are delimited by the rim deviate in terms of their length by at most 50%, preferably at most 30%. An ideally uniform external appearance of the exiting jet results in this way.

In one advantageous design embodiment it can alternatively or additionally be provided that rim portions in which the holes of the ring are delimited by the rim deviate in terms of their length from a largest available dimension of a largest and/or uncurtailed hole of the arrangement, in particular in the interior, by at most 50%, preferably at most 30%. The largest available dimension is typically chosen by balancing an ideally efficient pacification of the jet and an ideally minor interference of the jet. In this way, dimensioning of the holes chosen for the interior space of the jet can be transferred to the ring and thus to the outer individual jets.

BRIEF DESCRIPTION OF THE DRAWINGS

The invention will now be described in more detail by means of exemplary embodiments, but is not limited to these exemplary embodiments. Further exemplary embodiments are derived by combining the features of individual or a plurality of claims with one another and/or with individual or a plurality of features of the exemplary embodiments.

In the Figures.

DETAILED DESCRIPTION

Figure 1:
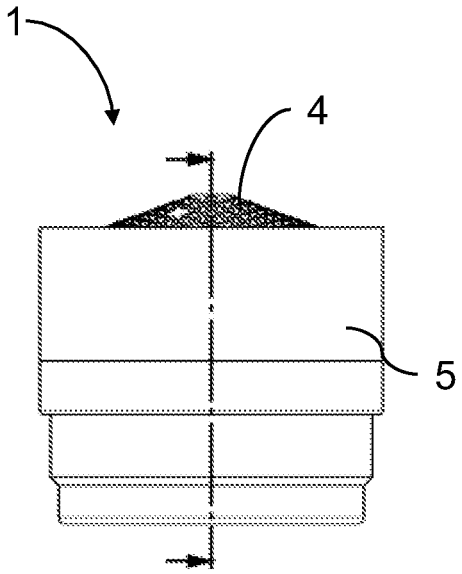
FIG. 1 shows a lateral view of a jet regulator according to the invention.
Figure 2:
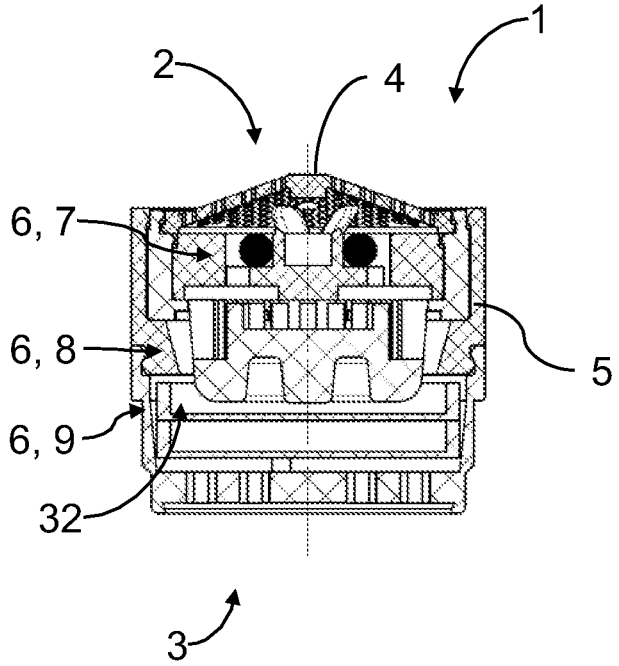
FIG. 2 shows the jet regulator as per FIG. 1 in an axial section.
Figure 3:
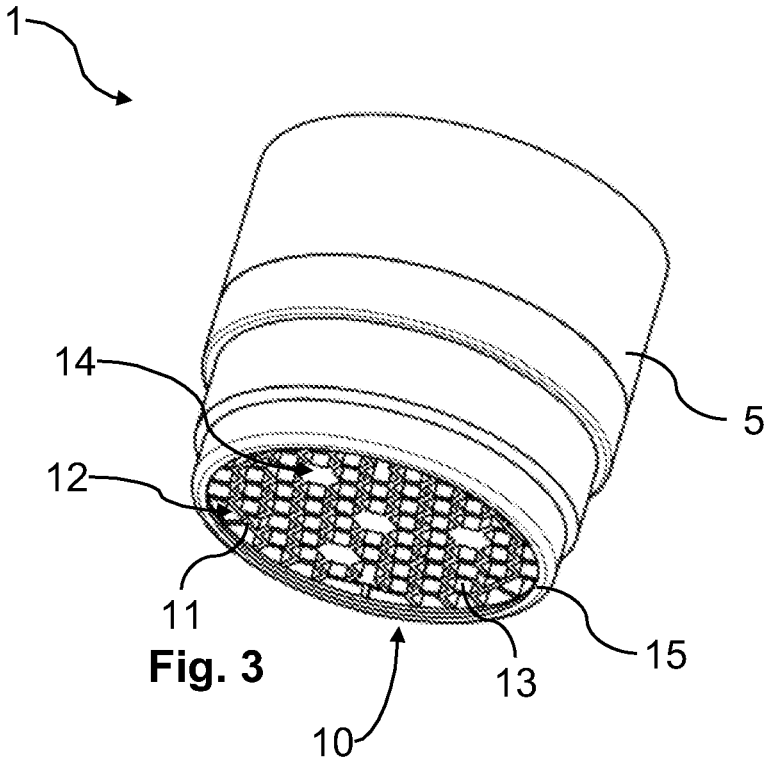
FIG. 3 shows the jet regulator as per FIG. 1 in a three-dimensional oblique view of the outlet structure of said jet regulator.

FIGS. 1 to 3 show a jet regulator according to the invention which overall is identified by the reference sign 1. The jet regulator 1 has an inflow side 2 and an outflow side 3. An attachment screen 4 through which water flows into an interior space 32 of a housing 5 is disposed on the inflow side 2. Functional units 6, for example a flow regulator 7 and/or a jet splitter 8 and/or a screen insert 9 can be disposed in the housing 5.

The jet regulator 1 can have lateral aeration openings so as to generate an aerated water jet, or can be non-aerated.

An outlet structure 10 is configured on the outflow side 3 on the housing 5.

Figure 4:
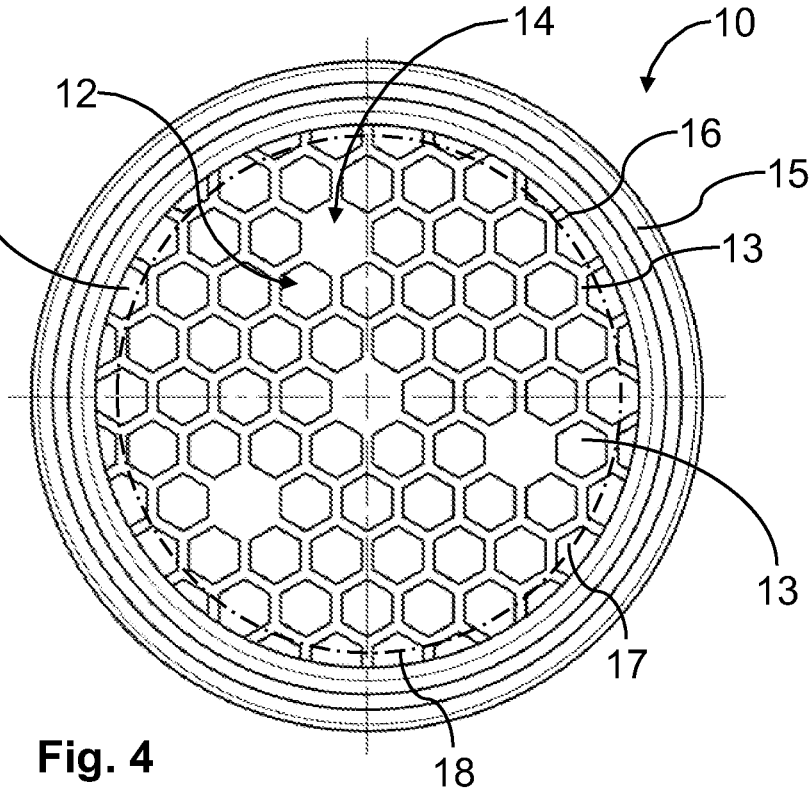
FIG. 4 shows an outlet structure of a jet regulator as per the prior art.

FIG. 4 shows an outlet structure 10 as per the prior art.

The outlet structure 10 has an outlet mesh 11 by way of which a regular arrangement 12 of holes 13 of identical size and identical shape is achieved. These holes 13 can be referred to as uncurtailed holes. Some holes are filled so that the regular arrangement 12 is interrupted at those locations 14.

The jet regulator 1 at the outflow side has an external contour 15 which is round here and forms a rim 16 that delimits the outlet mesh 11.

As a result of this rim 16, the regular arrangement 12 is interrupted and the holes 17 that are in each case adjacent to the rim 16 form an encircling ring 18. The ring 18 is thus configured so as to deviate from the regular arrangement 12 in that the rim 16 curtails individual holes 17 of the ring 18.

As a result of the regular arrangement 12 being delimited, the holes 17 have different opening cross sections, the latter varying from a full opening cross section of a hole 13 to a fraction of this opening cross section. These only partially configured holes 17 result in a deviation from the regular arrangement 12.

The holes 17 of the ring 18 define the external appearance of the exiting water jet.

One sub-jet exits each of the holes 13, 17 here, wherein the outlet mesh 11 is sized to be so thin that these sub-jets re-combine behind the outlet structure 10.

Figure 5:
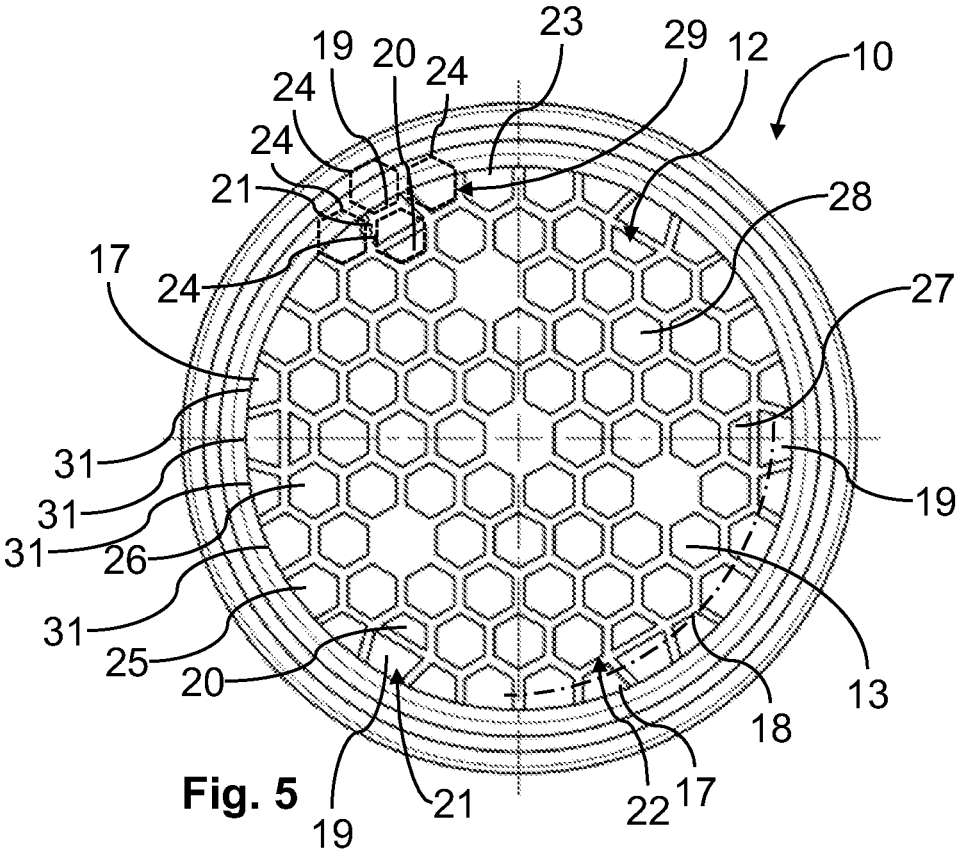
FIG. 5 shows an outlet structure of a jet regulator according to the invention.

FIG. 5 shows an outlet structure 10 of a jet regulator 1 according to the invention. Components and functional units which in terms of function or construction are equivalent or identical to the jet regulator 1 as per FIG. 4 are provided with the same reference signs and are not specially described once again. The explanations pertaining to FIG. 4 therefore apply in analogous manner to FIG. 5.

The hole 19 in the ring 18 is configured so as to be enlarged at the expense of the hole 20 in the interior 22, so as to avoid that the available opening cross section 21 of said hole 19, should the hole 20 retain the full hexagonal shape of the regular arrangement 12, the latter by way of example being hexagonal here, is less than half the size of an available opening cross section of the adjacent hole 17 in the ring 18, for example. The regular continuation of the regular arrangement 12 in the illustration is indicated by hexagons 24 represented by dashed lines.

Overall, this thus results in a ring 18 in which all holes 17, 19 are sized such that no available opening cross section is smaller than half of the available opening cross sections of the complete holes 13 of the regular arrangement 12.

It is in fact innocuous here that individual holes 20 in the interior 22 within the ring 18 turn out to be very small. It has been demonstrated that these small holes 20 do not interfere with the jet pattern because the associated sub-jets remain enclosed in the water jet.

It can be seen that the hole 19, if the latter were to be delimited by the hexagon 24, would deviate from the available opening cross section of an adjacent hole 23 by more than 20%.

It can furthermore be seen in FIG. 5 that individual holes 25 are enlarged in comparison to the holes 13 in the interior 22, so as to avoid the configuration of minute holes. In the outlet structure 10 the holes 17, 19, 25 that form the ring 18 are delimited toward the top so that the available opening cross sections are not more than 1.5 times the available opening cross sections of the holes 13 in the interior 22.

Overall, the distribution of the available opening cross sections across the outlet structure 10 is ideally homogenous, having deviations of less than 15% from a median or mean value or a largest hole 26 in the interior 22.

As a result of the enlargement of the holes 19, very small holes 27, of which the available opening cross section is less than 50% of a further hole 28 in the interior 22, are formed in the interior 22.

The outlet structure 10 in FIG. 5 has a six-fold rotational symmetry about the center, a point symmetry in relation to punctiform mirroring at the center, and three mirror symmetries on straight lines through the center.

Figure 6:
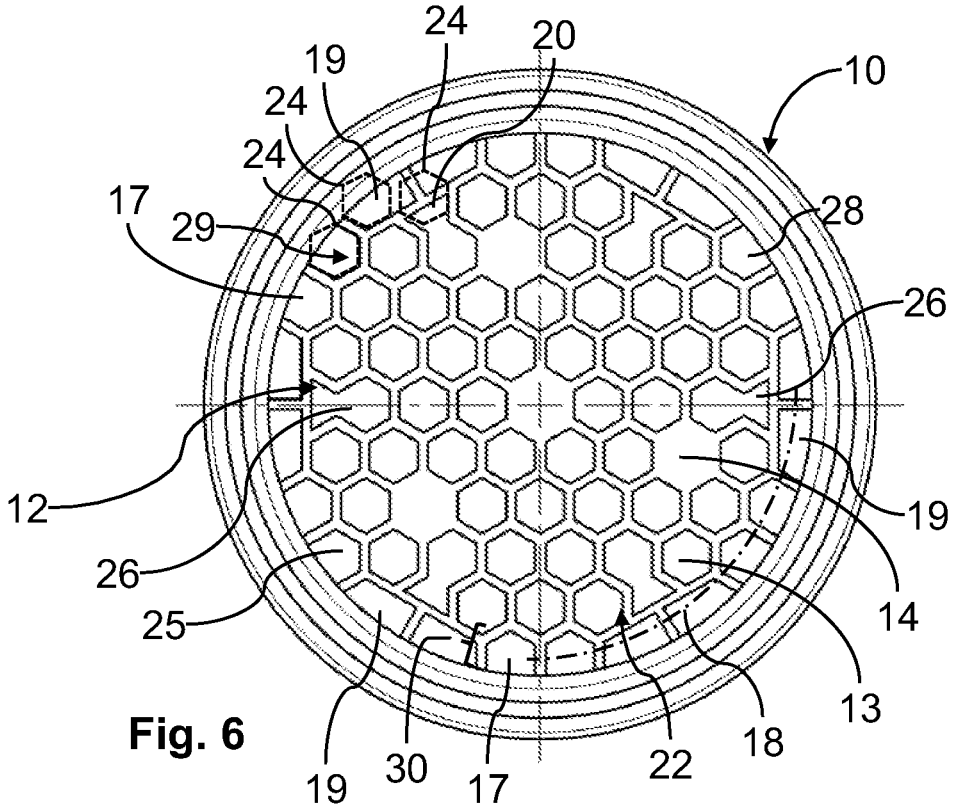
FIG. 6 shows an outlet structure of a second jet regulator according to the invention.

FIG. 6 shows an outlet structure 10 of a further jet regulator according to the invention. Components and functional units which in terms of function and/or construction are equivalent or identical to the preceding exemplary embodiments are provided with the same reference signs and are not specially described once again. The explanations pertaining to the preceding figures therefore apply in analogous manner to FIG. 6.

Deviating from FIG. 5, largest holes 26 are formed in the interior 22 in that very small holes have been combined with complete holes 13.

Furthermore, the holes 19 in the ring 18 have been significantly enlarged but are still smaller than the available opening cross section of the largest holes 26.

Figure 7:
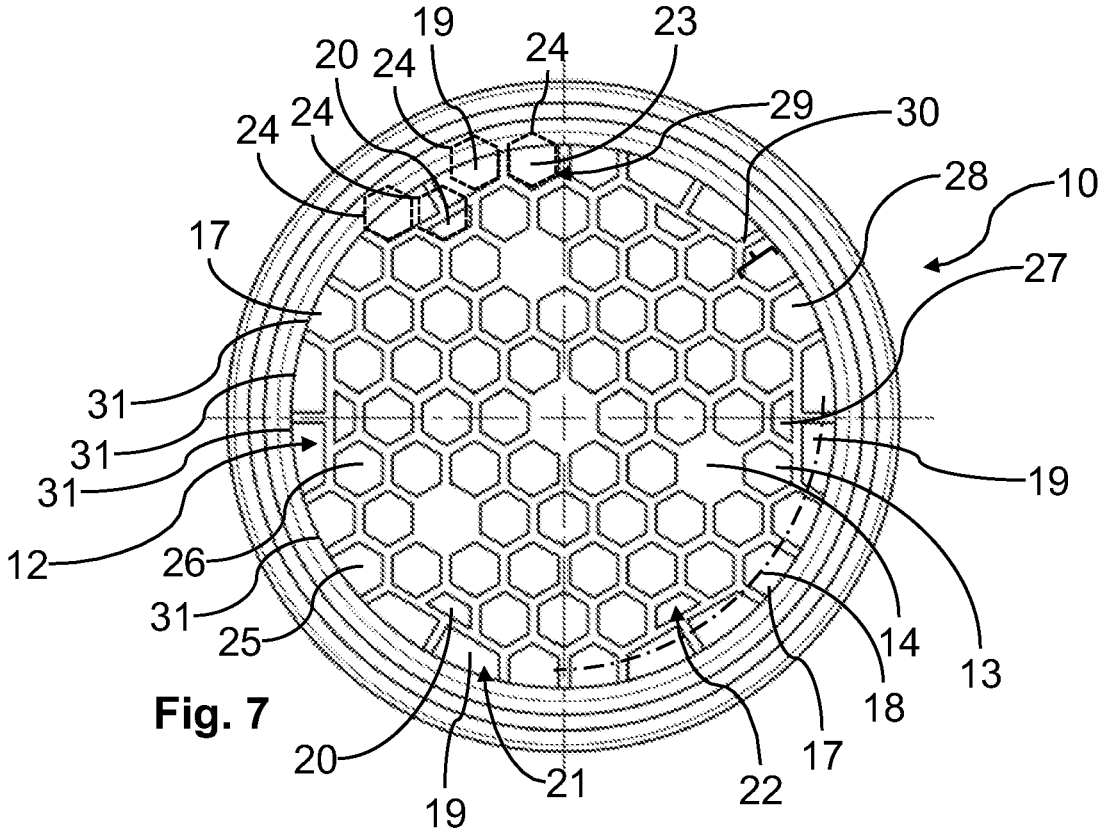
FIG. 7 shows an outlet structure of the third jet regulator according to the invention.

FIG. 7 shows an outlet structure 10 of a further jet regulator according to the invention. Components and functional units which in terms of function and/or construction are equivalent or identical to the preceding exemplary embodiments are provided with the same reference signs and are not specially described once again. The explanations pertaining to the preceding figures therefore apply in analogous manner to FIG. 7.

FIG. 7 represents a combination of the examples as per FIGS. 5 and 6.

Here too, the available opening cross section of the holes 19 is not more than 1.5 times the opening cross sections of the largest holes 26 in the interior.

While the available opening cross section of the hole 23 is likewise being curtailed, this reduction is still acceptable in terms of the configuration of appealing sub-jets.

The outlet structure 10 in the interior 22 has at least one hole 20 which lies adjacent to the ring 18 and of which the available opening cross section is less than 50% of a further hole 28 in the ring 18 and of a largest hole 26 in the interior 22.

It can also be seen in FIGS. 5 to 7, in particular in a comparison with the plotted hexagons 24, that the enlarged hole 19 in at least one portion 29 assumes a shape of the regular arrangement 12. This even applies to all holes 17, 19, 25 in the ring 18, the portions 29 particularly facing in each case the interior 22.

In general, it can be stated that the holes 17, 19, 25 that form the ring 18 have mutually deviating available opening cross sections 21.

It can also be seen in the figures that the hole 20, which lies in the interior 22 of the outlet structure 10 and is adjacent to a hole 19 of the ring 18, is curtailed by this hole 19 of the ring 18 in such a manner that the available opening cross section of said hole 20 is smaller than that of the uncurtailed holes 13 of the regular arrangement 12.

It can also be seen that no hole 19 of the ring 18 has an available cross section that is smaller than half of an available opening cross section of the uncurtailed holes 13 of the regular arrangement 12.

It can moreover be seen that a width 30 of the ring 18, thus a dimension transverse to the encircling direction of the ring 18, is delimited by a largest available dimension of a largest and (uncurtailed) hole 13 of the regular arrangement 12 in the interior 22.

Finally, it can be seen that rim portions 31 in which the holes 17, 19, 25 of the ring 18 are delimited by the rim 16 have in each case a length which is at least half of a largest available dimension of an uncurtailed hole 13 of the arrangement 12 in the interior 22.

These rim portions 31 mutually deviate in terms of their length and deviate from a largest available dimension of an uncurtailed hole 13 of the regular arrangement 12 in the interior 22 by at most 50%, here even by at most 30%.

In further exemplary embodiments the holes 19 are enlarged at the expense of an adjacent hole in the ring.

In general, it can be stated that a shape and an arrangement of enlarged or curtailed holes 19 maintain a rotational symmetry of the regular arrangement 12.

In an outlet structure 10 of a jet regulator 1 according to the invention it is thus proposed to configure holes 17, 19, 25 in the rim region of a regular arrangement 12 so as to be enlarged in relation to the regular arrangement 12, so as to avoid the configuration of small holes 17, 19, 25 in the rim region.

LIST OF REFERENCE SIGNS

1 Jet regulator
2 Inflow side
3 Outflow side
4 Attachment screen
5 Housing
6 Functional unit
7 Flow regulator
8 Jet splitter
9 Screen insert
10 Outlet structure
11 Outlet mesh
12 Regular arrangement
13 (Uncurtailed) hole
14 Location
15 External contour
16 Rim
17 Hole
18 Ring
19 Hole
20 Hole
21 Available opening cross section
22 Interior
23 Adjacent hole
24 Hexagon
25 Hole
26 Largest hole
27 Small hole
28 Further hole
29 Portion
30 Width of 18
31 Rim portion
32 Interior space

The invention claimed is:

1. A jet regulator (1) comprising:

an outlet structure (10) with an outlet mesh (11) having a regular arrangement (12) of holes (13) and a rim (16) that delimits the outlet mesh (11);

holes (17, 19, 25) of the outlet structure (10) adjacent to the rim (16) form a ring (18) and externally delimit a water jet flowing through the outlet structure (10);

the ring (18) is configured so as to deviate from the regular arrangement (12) in that at least one hole (17, 19, 25) of the ring (18), should an available opening cross section (21) thereof otherwise based on a continuation of the regular arrangement (12), be less than half a size of an available opening cross section (21) of an adjacent hole (23), is enlarged so as to deviate from the regular arrangement (12), wherein at least one said hole (20) which lies in an interior (22) of the outlet structure (10) and is adjacent to one of the holes (17, 19, 25) of the ring (18) is curtailed by said hole (17, 19, 25) of the ring (18) such that the available opening cross section (21) of said at least one hole (20) is smaller than that of at least one of a largest or uncurtailed holes (13) of the regular arrangement (12).

2. The jet regulator (1) as claimed in claim 1, wherein in the regular arrangement (12) of the holes (13), the holes (13) have at least one of an identical size or an identical shape.

3. The jet regulator (1) as claimed in claim 1, wherein the ring (18) is configured so as to deviate from the regular arrangement (12) in that the rim (16) curtails individual ones of the holes (17, 19, 25) of the ring (18).

4. The jet regulator (1) as claimed in claim 1, wherein the enlarged hole of the ring (18) is enlarged with an area of at least one adjacent one of the holes (17, 19, 25) in at least one of the ring (18) or an interior (22) of the outlet structure (10).

5. The jet regulator (1) as claimed in claim 1, wherein the at least one of the holes (17, 19, 25) of the ring (18) is enlarged so as to deviate from the regular arrangement (12) when the available opening cross section (21) of said hole (17, 19, 25) otherwise, in the case of a continuation of the regular arrangement (12), deviates from the available opening cross section (21) of the adjacent hole (23) by more than 15%.

6. The jet regulator (1) as claimed in claim 1, wherein the holes (17, 19, 25) of the ring (18) have the available opening cross sections (21) which are at most 50% larger than the available opening cross section (21) of one of the holes (13, 20, 26) in an interior (22) of the outlet structure (10).

7. The jet regulator (1) as claimed in claim 1, wherein the available opening cross sections (21) of the holes (17, 19, 25) of the ring (18) vary by at most 15%.

8. The jet regulator (1) as claimed in claim 1, wherein the outlet structure (10) has at least one of a rotational symmetry, mirror symmetry or point symmetry.

9. The jet regulator (1) as claimed in claim 1, wherein the outlet structure (10) has a hexagonal arrangement.

10. The jet regulator (1) as claimed in claim 1, wherein the outlet structure (10) in an interior (22) thereof, has at least one said hole (20) of which the available opening cross section (21) is smaller than 50% of a further one of the holes (28) in at least one of the ring (18) or in the interior (22).

11. The jet regulator (1) as claimed in claim 1, wherein the enlarged hole (19) in at least one portion (29) has a shape of the regular arrangement (12).

12. The jet regulator (1) as claimed in claim 1, wherein the holes (17, 19, 25) that form the ring (18) have mutually deviating ones of the available opening cross sections (21).

13. The jet regulator (1) as claimed in claim 1, wherein at least one said hole (20) which lies in an interior (22) of the outlet structure (10), at the expense of which one of the holes (17, 19, 25) in the ring (18) has been enlarged, is unified with a further hole (13) in the interior (22) of the outlet structure (10) to form a larger hole (26).

14. The jet regulator (1) as claimed in claim 1, wherein none of the holes (17, 19, 25) of the ring (18) has the available opening cross section (21) which is smaller than half of the available opening cross section (21) of at least one of a largest or uncurtailed one of the holes (13, 26) of the regular arrangement (12).

15. The jet regulator (1) as claimed in claim 1, wherein at least one of a shape or an arrangement of enlarged ones of the holes (17, 19, 25) maintains a rotational symmetry of the regular arrangement (12).

16. The jet regulator (1) as claimed in claim 1, wherein a width (30) of the ring (18) is delimited by a largest available dimension of at least one of a largest or uncurtailed one of the holes (13, 26) of the regular arrangement (12).

17. The jet regulator (1) as claimed in claim 1, wherein rim portions (31) in which the holes (17, 19, 25) of the ring (18) are delimited by the rim (16) have in each case a length which is at least half of a largest available dimension of at least one of a largest or uncurtailed one of the holes (13) of the regular arrangement (12).

18. The jet regulator (1) as claimed in claim 1, wherein the rim (16) is circular.

19. The jet regulator (1) as claimed in claim 1, wherein at least one hole (20), at the expense of which one of the holes (17, 19, 25) in the ring (18) has been enlarged, has an opening cross section (21) which differs from zero.

* * * * *